US006776981B2

(12) United States Patent
Elliott et al.

(10) Patent No.: US 6,776,981 B2
(45) Date of Patent: Aug. 17, 2004

(54) PERSONAL CARE PRODUCT

(75) Inventors: David L. Elliott, North Attleboro, MA (US); Iris Davis Gersten, Rockville, MD (US); Hermes van der Lee, Rockville, MD (US); James L. Solan, Rockville, MD (US); Gordon G. Guay, Chelmsford, MA (US)

(73) Assignee: The Gillette Company, Boston, MA (US)

( * ) Notice: Subject to any disclaimer, the term of this patent is extended or adjusted under 35 U.S.C. 154(b) by 181 days.

(21) Appl. No.: 10/059,467

(22) Filed: Jan. 29, 2002

(65) Prior Publication Data

US 2003/0143169 A1 Jul. 31, 2003

(51) Int. Cl.[7] ..... A61K 7/32; A61K 7/00
(52) U.S. Cl. ..... 424/65; 424/400; 424/401
(58) Field of Search ..... 424/65, 400, 401; 401/68, 82, 83, 84, 175, 176

(56) References Cited

U.S. PATENT DOCUMENTS

| | | | |
|---|---|---|---|
| 27,864 | A | 11/1860 | Blackman |
| 692,481 | A | 2/1902 | Robinson |
| 964,422 | A | 7/1910 | Hood |
| 1,669,016 | A | 5/1928 | O'Neil |
| 1,791,359 | A | 2/1931 | Henriksen |
| 2,101,540 | A | 12/1937 | Gullich |
| 2,165,420 | A | 7/1939 | Siefert |
| 2,174,779 | A | 10/1939 | Delorme |
| 2,613,185 | A | 10/1952 | Marshall |
| 2,970,083 | A | 1/1961 | Bell |
| D201,229 | S | 5/1965 | Burke |
| 3,294,692 | A | 12/1966 | Kelly et al. |
| 3,479,429 | A | 11/1969 | Morshauser et al. |
| 4,120,948 | A | 10/1978 | Shelton |
| 4,202,879 | A | 5/1980 | Shelton |
| 4,393,643 | A | 7/1983 | Fryar et al. |
| 4,511,552 | A | 4/1985 | Cox |
| 4,524,062 | A | 6/1985 | Laba et al. |
| 4,578,207 | A | 3/1986 | Holdt et al. |
| 4,714,085 | A | 12/1987 | von Kleinsorgen |
| 4,743,443 | A | 5/1988 | Pisani et al. |
| 4,786,449 | A | 11/1988 | Smit |
| 4,879,063 | A | 11/1989 | Wood-Rethwill et al. |
| 5,217,639 | A | 6/1993 | Mottola |
| D344,154 | S | 2/1994 | Mottola |
| 5,330,751 | A | 7/1994 | Curtin et al. |
| 5,417,964 | A | 5/1995 | Carlson, Sr. et al. |
| 5,496,122 | A | 3/1996 | Fattori |
| 5,538,161 | A | 7/1996 | Koehler et al. |
| 5,587,153 | A | 12/1996 | Angelone, Jr. et al. |
| 5,705,171 | A | 1/1998 | Iovanni et al. |
| 5,753,212 | A | 5/1998 | Pescatore et al. |
| 5,759,974 | A | 6/1998 | Menke et al. |
| 5,965,501 | A | 10/1999 | Rattinger |
| 5,984,553 | A | 11/1999 | Piscopo et al. |
| D423,713 | S | 4/2000 | Szekely |
| 6,085,759 | A | 7/2000 | Joulia |
| D430,346 | S | 8/2000 | van der Hagen |
| 6,096,296 | A | 8/2000 | Alflen et al. |
| D443,951 | S | 6/2001 | Look |
| D444,264 | S | 6/2001 | Look |
| D444,265 | S | 6/2001 | Look |
| D444,593 | S | 7/2001 | Look |
| D444,913 | S | 7/2001 | Look |
| D446,356 | S | 8/2001 | Look |
| D446,606 | S | 8/2001 | Look |
| D446,607 | S | 8/2001 | Look |
| D454,227 | S | 3/2002 | Look |
| D454,228 | S | 3/2002 | Look |
| D454,229 | S | 3/2002 | Look |
| D454,414 | S | 3/2002 | Look |
| D454,661 | S | 3/2002 | Look |
| D454,662 | S | 3/2002 | Look |
| D454,663 | S | 3/2002 | Look |
| D454,664 | S | 3/2002 | Look |
| D454,665 | S | 3/2002 | Look |
| D454,666 | S | 3/2002 | Look |
| D454,983 | S | 3/2002 | Look |
| D454,984 | S | 3/2002 | Look |
| D454,985 | S | 3/2002 | Look |
| D457,263 | S | 5/2002 | Gersten et al. |
| 6,506,369 | B2 * | 1/2003 | Ambler et al. |
| 2002/0041788 | A1 | 4/2002 | Look et al. |
| 2002/0109261 | A1 | 8/2002 | Grosz et al. |
| 2002/0109262 | A1 | 8/2002 | Grosz et al. |
| 2002/0155077 | A1 | 10/2002 | Galante et al. |

FOREIGN PATENT DOCUMENTS

| | | |
|---|---|---|
| DE | 199 21 183 A1 | 9/2000 |
| EP | 1 161 894 A2 | 12/2001 |
| FR | 977194 | 3/1951 |
| GB | 927706 | 6/1963 |
| GB | 2014507 A | 2/1979 |
| GB | D2081820 | 7/1999 |
| WO | WO 99/23998 | 5/1999 |
| WO | WO 00/19861 | 4/2000 |
| WO | WO 02/092040 A2 | 11/2002 |

OTHER PUBLICATIONS

The Body Shop Skin & Hair Care Products catalog holiday edition c 1995; p. 16 makeup indicated by arrows.
"bac deo–stick", undated.
"bac deo–stick" undated.

* cited by examiner

*Primary Examiner*—Shelley A. Dodson
(74) *Attorney, Agent, or Firm*—Fish & Richardson P.C.

(57) ABSTRACT

A product for application to skin includes a container having an open end, a non-flowable composition within the container including an application surface at the open end having a visual pattern, and a removable cap having a % opacity of less than 5%.

32 Claims, 2 Drawing Sheets

PERSONAL CARE PRODUCT

TECHNICAL FIELD

This invention relates to products, for example, antiperspirants and deodorants, that are topically applied to the skin.

BACKGROUND

Antiperspirant and deodorant compositions are well known personal care products. The compositions come in a variety of forms and may be formulated, for example, into aerosols, pumps, sprays, liquids, roll-ons, lotions, creams, and sticks (both hard and soft), etc.

There are various types of stick antiperspirant compositions. In one type, an antiperspirant salt is suspended in an anhydrous vehicle often including a solid water-insoluble wax. In a second type, an antiperspirant salt is dissolved in a liquid vehicle such as propylene glycol and gelled with a gelling agent such as dibenzylidene sorbitol. A third type includes an emulsion of an aqueous phase containing the antiperspirant salt and an oil phase containing, for example, a volatile silicone, fragrances, gellants, and other additives.

Stick antiperspirant products include an antiperspirant composition within a container. During use of the product, the top of the container is removed and the application surface of the composition is contacted with the underarm. Sometimes the product also includes an undercap, or factory seal, covering the application surface that is removed prior to first use. During use, some of the composition is transferred to the skin, and the container generally also includes some mechanism for moving the composition upwards through the container to continue to provide an exposed application surface.

SUMMARY

Generally, the invention in one aspect relates to a product for application to the skin. The product includes a container having an open end and a non-flowable composition within the container. The product also includes a removable cap having a % opacity of less than 5%, preferably less than 3.5%, and more preferably less than 2.5%, that encloses the open end of the container and, as a result, the application surface. The composition has an application surface at the open end of the container. The application surface continuously wears away during application of the composition to the skin. The composition includes a cosmetic ingredient such as an antiperspirant salt, deodorant active ingredient, sunscreen, vitamin E, aloe, alphahydroxy acid, fragrance and/or a therapeutic ingredient such as a pharmaceutically active compound (e.g., anti-inflammatory agent, hair growth promoter or inhibitor, vitamin E, a alphahydroxy acid, etc.). "Non-flowable", as used herein, means the composition does not flow out of the container when the container is inverted at room temperature. "Within the container", as used herein, means that at least part of the composition is within the container.

In some embodiments, the application surface may include a visual pattern. The pattern may be, for example, a stripe having a different color or opaqueness than the surrounding application surface. "Different color" as used herein, includes different shades of a color. White and black are considered colors.

In some embodiments the product also includes an undercap (also referred to as a factory seal) having a % opacity of less than 15%, preferably less than 12%, more preferably less than 10%, and most preferably less than 7%. In some embodiments the cap in combination with the undercap has a % opacity of less than 15%, preferably less than 12%, and more preferably less than 10%.

Using a cap and, in some embodiments, an undercap, with low % opacities, with a product including a visible pattern has the benefit of allowing a user to observe the pattern without removing the cap and (in some embodiments) the undercap. In addition, where the visible pattern functions as a usage indicator as described in U.S. Ser. No. 09/859,073, filed May 16, 2001, the cap allows observation of the usage indicator. The aforementioned application is owned by the same owner as the present application and its disclosure, in particular its disclosure of usage indicators, is hereby incorporated by reference.

In another aspect of the invention, the product includes an undercap having a visible pattern on its outer surface. The application surface of the composition may include the same or different pattern, or may include no pattern.

In another aspect of the invention, the product includes an undercap having a % opacity of less than 30%, preferably less than 20%, more preferably less than 15%, and most preferably less than 10%. The product may also include a removable cap.

In another aspect of the invention, the product includes a cap that in combination with the undercap has a % opacity of less than 30%, preferably less than 20%, more preferably less than 15%, and most preferably less than 10%.

To assess the degree of clarity of a cap or undercap, the BYK Gardner Color-Guide 45/0 (Catalog #LCB-6800), a hand-held spectrophotometer, is used. This instrument has a standard measurement function for % Opacity. The opacity measurement uses the L*a*b* color scale and is based on readings obtained when the material is placed in front of a black background versus a white background. Standard black and white color sheets from BYK Gardner (Catalog #LAR-3700) were used for the analyses. Measurements resulting in 100% opacity (0% clarity) indicate that there is no difference between the material with a black or white background. Therefore, no light passes through the material. Measurements resulting in 0% opacity indicate that all light passes through a material (therefore, 100% clarity). Generally, six replicate measurements are made; % opacity is the average of the six measurements.

Other features, objects, and advantages of the invention will be apparent from the description of the embodiment and from the claims.

DETAILED DESCRIPTION

Figure 1:
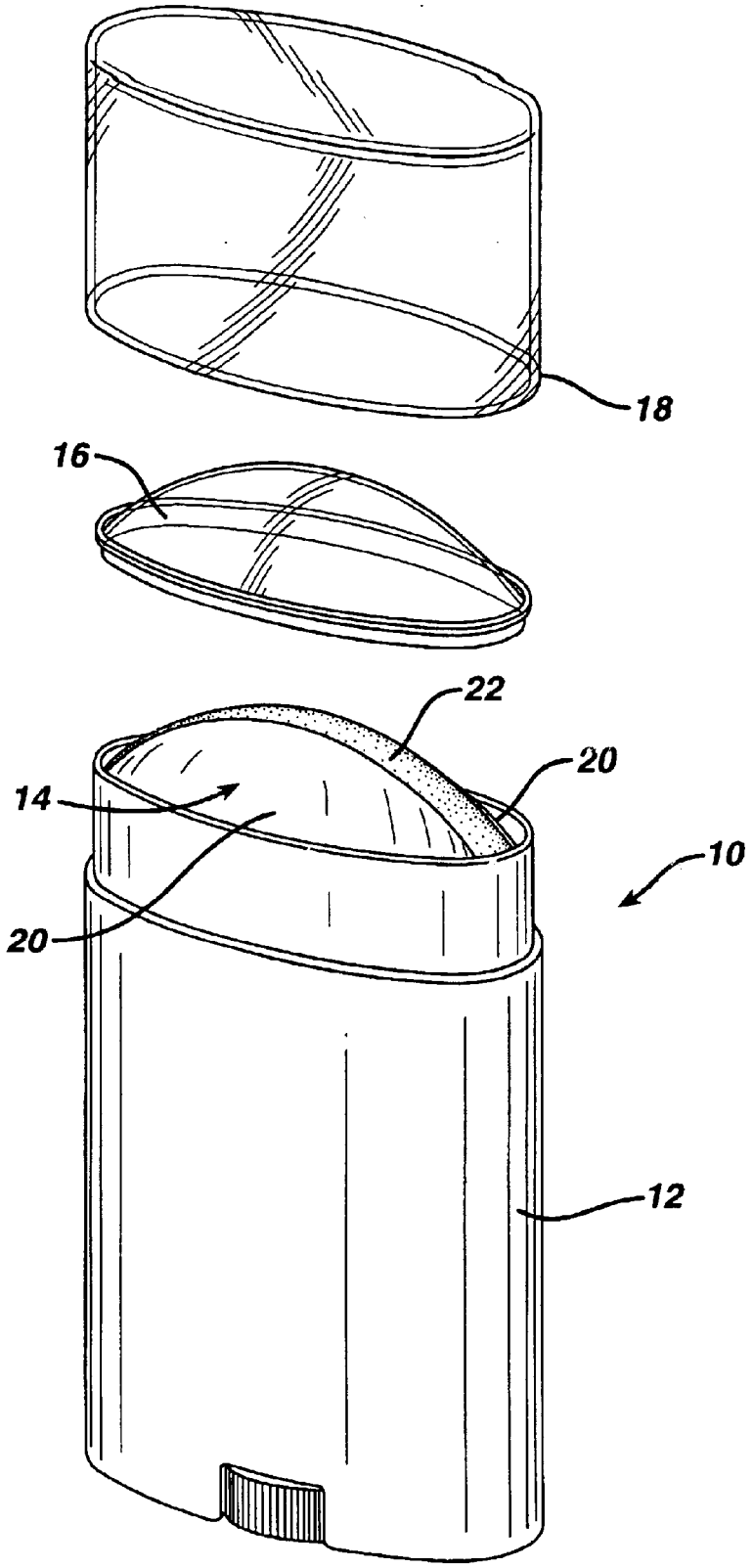
FIG. 1 is an exploded view of an antiperspirant product.

Referring to FIG. 1, an antiperspirant product 10 includes a container 12 and a composition within the container having a domed application surface 14 for application to an underarm. The application surface can also be, for example, flat. Product 10 also includes an undercap 16 (the factory seal) having a % opacity of less than 15% and cap 18 having a % opacity of less than 5%.

The composition includes portions 20 and 22 that together define application surface 14. Portion 22 is in the form of a stripe centrally running through and dividing portion 20. Portions 20 and 22 have different compositions and portion 22 has a different color than portion 20. For example, portion 22 may be dark blue, light blue, dark green, or light green, and portion 20 may be white, or vice versa. Because portions 20 and 22 have different colors, application surface 14 has a striped appearance. Portion 22 has a width preferably between 0.2 inch and 0.5 inch. In product 10 portion 22 has a width of about 0.25 inch.

Other visual patterns are described in U.S. Ser. No. 09/784,488, which is owned by the same owner as the present application and is hereby incorporated by reference. For example, the visual pattern can be multiple stripes, a diagonal stripe, a wavy stripe, or a half-and-half design in which the halves of the application surface have different colors or opaqueness. Alternatively, the pattern may include any number of central portion/outer portion designs in which a centrally located portion is surrounded by an outer portion having a different color or opaqueness.

The components used in portions 20 and 22, and how the composition can be made, are described in U.S. Ser. No. 09/784,488. See also U.S. Ser. No. 09/784,487 and U.S. Ser. No. 09/784,493 both filed Feb. 15, 2001, both of which also are owned by the same owner as the present application and are hereby incorporated by reference, for further details of methods that can be used to manufacture compositions including two portions.

Container 12 can be made of polymers such as polypropylene and polyethylene. Undercap 16 preferably is made from polypropylene and cap 18 preferably is made from polyethylene terephthalate (PET). The cap alternatively also can be made from, for example, polystyrene, polycarbonate, acrylic, polypropylene, styrene acrylonitrile, and Kraton. The undercap alternatively can be made from, for example, PET.

Figure 2:
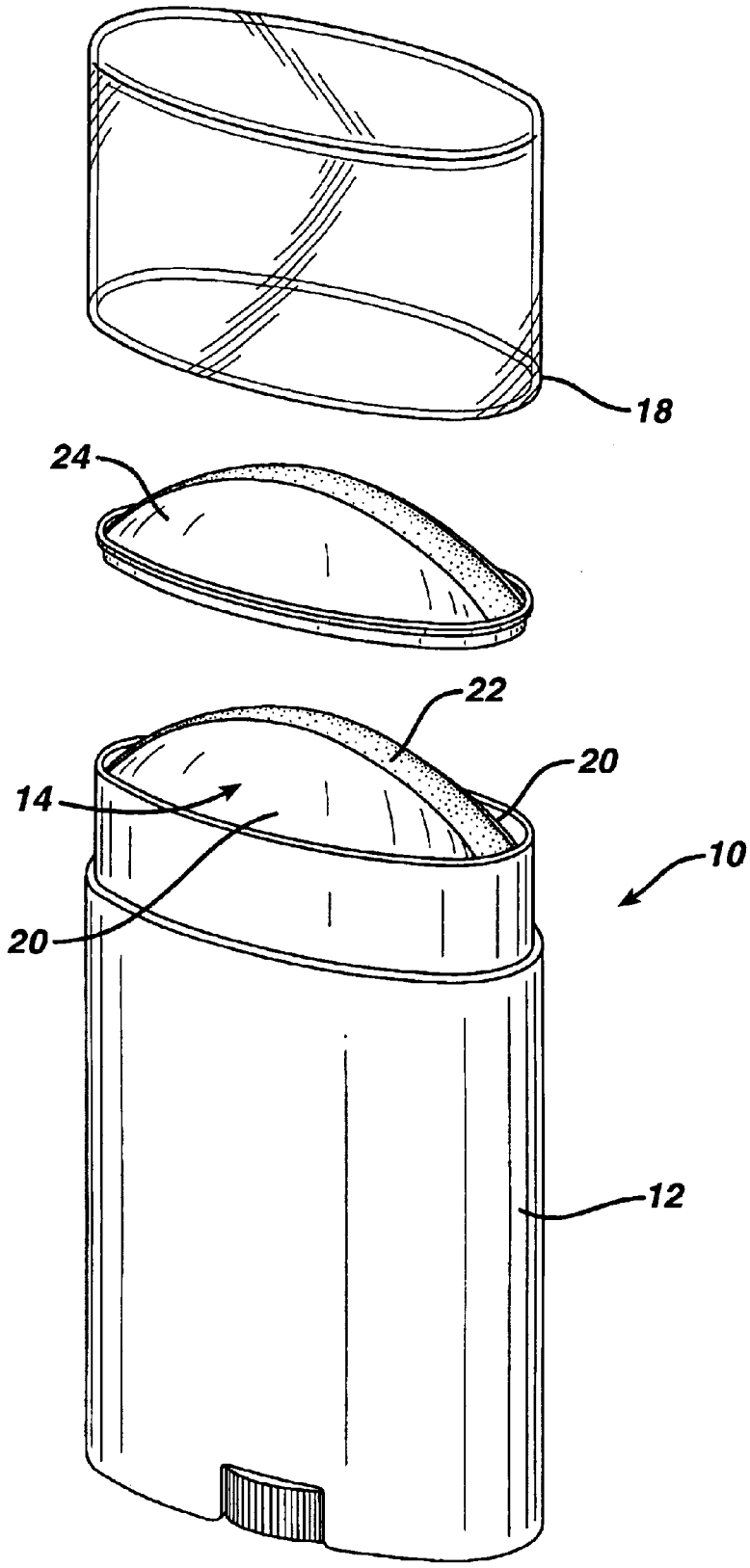
FIG. 2 is a perspective view of an alternative undercap that can be used with the product in FIG. 1.

Referring to FIG. 2, in an alternative embodiment, undercap 24 includes a color stripe generally corresponding in size and color to portion (stripe) 22. The color of the stripe on undercap 24 may even be more vibrant than the underlying stripe on the application surface. The remainder of the undercap may be opaque (e.g., white) or have a % opacity, for example, of less than 15%. Having a pattern on the undercap generally corresponding to the initial application surface of the underlying composition is advantageous in that the undercap will signal consumers that the underlying composition has a pattern in the initial application surface. Typically, undercap 24 is removed prior to first use and discarded, and thus subsequently users view an application surface of the composition.

An embodiment was prepared including a striped antiperspirant/deodorant composition described in U.S. Ser. No. 09/784,488 (incorporated by reference previously), a PET cap having a thickness of about 0.025 inch obtained from the Plastek Group, Erie, Pa., and a polypropylene undercap having a thickness of 0.025 inch also obtained from the Plastek Group. The PET cap had a % opacity of 2.10±0.10%. The polypropylene undercap had a % opacity of 5.66±0.13%. The cap in combination with the undercap (undercap placed inside cap) had a % opacity of 8±0.46%.

Caps from the following products were tested for % opacity.

1. Right Guard Xtreme Sport, Invisible Solid, Fresh Blast, and 2.8 oz. size.
2. Soft & Dri, Invisible Solid, Baby Powder, 2.6 oz. size.
3. Bac Double Action Deo-Stick, Energy, 40 ml size.
4. Lady Speed Stick, Invisible Dry, Wild Freesia, 2.3 oz. size.
5. Lady Mitchum Cool Dry, Hydro Solid, Shower Fresh, 1.5 oz. size.
6. Secret Sheer Dry, Gel Solid, Regular, 2.6 oz. size.
7. Degree, Invisible Solid, Mountain Air, 2.6 oz. size.
8. Suave Naturals, Invisible Solid, Aloe Vera, 2.6 oz. size.
9. Old Spice High Endurance, Deodorant Stick, Fresh, 2.25 oz. size.

Six replicate measurements were obtained. The measurements were taken at varying locations on the package. Standard deviations were calculated from the replicate measurements. The average of the results (average % Opacity) are shown in the following table.

| Sample | % Opacity | Standard Deviation |
|---|---|---|
| RG Xtreme | 20.15 | 1.00 |
| Soft & Dri | 18.50 | 0.65 |
| Bac | 28.91 | 0.58 |
| Lady Speed Stick | 14.49 | 0.11 |
| Lady Mitchum | 6.64 | 0.33 |
| Secret | 19.80 | 0.64 |
| Degree | 7.60 | 0.68 |
| Suave | 8.29 | 0.33 |
| Old Spice | 13.26 | 0.47 |

The standard deviations are based on the six replicate readings, and are due to minor imperfections in the packaging materials.

The PET cap used with the embodiment has the lowest %.

Other embodiments are within the claims.

What is claimed is:

1. A product for application to skin, comprising a container having an open end; a non-flowable cosmetic composition within the container having an application surface at the open end, the application surface having a visual pattern; and a removable cap having a % opacity of less than 5% that encloses the open end of the container and the application surface, thereby permitting a user to see the visual pattern on the application surface.

2. The product of claim 1, wherein the visual pattern comprises at least two portions of the application surface having different colors.

3. The product of claim 1 wherein the application surface comprises at least two portions having different colors, thereby providing the visual pattern.

4. The product of claim 3, wherein the visual pattern comprises a stripe.

5. The product of claim 4, wherein the stripe extends centrally lengthwise across the application surface.

6. The product of claim 3, wherein approximately half to two thirds of the application surface is a first color and approximately one third to one half of the application surface is a second color.

7. The product of claim 3, wherein a central portion of the application surface has a first color and a portion of the application surface generally surrounding the central portion has a second color.

8. The product of claim 1, wherein the visual pattern comprises at least two portions of the application surface having different opacities.

9. The product of claims 1, wherein the composition comprises an antiperspirant and/or deodorant active.

10. The product of claim 1, further comprising an undercap having a % opacity of less than 30% beneath the cap.

11. The product of claim 1, wherein the removable cap comprises PET.

12. The product of claim 10, wherein the undercap comprises polypropylene.

13. The product of claim 10, wherein the undercap has a % opacity of less than 15%.

14. The product of claim 13, wherein the undercap has a % opacity of less than 10%.

15. The product of claim 10, wherein the cap and the undercap combination has a % opacity of less than 30%.

16. The product of claim 15, wherein the cap and the undercap combination has a % opacity of less than 15%.

17. The product of claim 1, wherein the removable cap has a % opacity of less than 3%.

18. A product for application to skin, comprising a container having an open end; a non-flowable cosmetic composition within the container having an application surface at the open end; an undercap covering the application surface and having an outer surface comprising a visual pattern; and a removable cap having a % opacity of less than 5% that encloses the open end of the container and the undercap.

19. The product of claim 18, wherein the application surface also has a visual pattern.

20. The product of claim 18, wherein the composition comprises an antiperspirant and/or deodorant active.

21. A product for application to skin, comprising a container having an open end, and a non-flowable cosmetic composition within the container having an application surface at the open end, the application surface having a visual pattern; an undercap having a % opacity of less than 30%; and a removable cap that encloses the open end of the container and the undercap.

22. The product of claim 21, wherein the composition comprises an antiperspirant and/or deodorant active.

23. The product of claim 21, wherein the undercap has a % opacity of less than 15%.

24. The product of claim 22, wherein the undercap has a % opacity of less than 10%.

25. The product of claim 21, wherein the cap and the undercap combination has a % opacity of less than 30%.

26. The product of claim 25, wherein the cap and undercap combination has a % opacity of less than 15%.

27. The product of claim 21, wherein the removable cap has a % opacity of less than 15%.

28. The product of claim 27 wherein the removable cap has a % opacity of less than 10%.

29. A product for application to skin, comprising a container having an open end; a non-flowable cosmetic composition within the container having an application surface at the open end, the application surface having a visual pattern; an undercap covering the application surface; and a removable cap that encloses the open end of the container and the undercap, wherein the cap and the undercap combination has a % opacity of less than 30%.

30. The product of claim 29, wherein the composition comprises an antiperspirant and/or deodorant active.

31. The product of claim 29, wherein the cap and the undercap combination has a % opacity of less than 15%.

32. The product of claim 31, wherein the cap and undercap combination has a % opacity of less than 10%.

* * * * *

UNITED STATES PATENT AND TRADEMARK OFFICE

CERTIFICATE OF CORRECTION

PATENT NO. : 6,776,981 B2
DATED : August 17, 2004
INVENTOR(S) : David L. Elliott, Ph.D. et al.

It is certified that error appears in the above-identified patent and that said Letters Patent is hereby corrected as shown below:

Title page,
Item [56], References Cited, FOREIGN PATENT DOCUMENTS, after "DE 199 21 183 A1", replace "9/2000" with -- 11/2000 --.

Column 4,
Line 62, replace "claims" with -- claim --.

Signed and Sealed this

Fifth Day of July, 2005

JON W. DUDAS
*Director of the United States Patent and Trademark Office*